US008622508B2

(12) United States Patent
North et al.

(10) Patent No.: US 8,622,508 B2
(45) **Date of Patent: *Jan. 7, 2014**

(54) PRINTHEAD HAVING VARIABLE DRIVE PULSES FOR FLUID EJECTION

(75) Inventors: Angus John North, Balmain (AU); Jennifer Mia Fishburn, Balmain (AU); Samuel James Myers, Balmain (AU); Kia Silverbrook, Balmain (AU)

(73) Assignee: Zamtec Ltd, Dublin (IE)

( * ) Notice: Subject to any disclaimer, the term of this patent is extended or adjusted under 35 U.S.C. 154(b) by 127 days.

This patent is subject to a terminal disclaimer.

(21) Appl. No.: 13/216,199

(22) Filed: Aug. 23, 2011

(65) Prior Publication Data

US 2011/0310149 A1 Dec. 22, 2011

Related U.S. Application Data

(63) Continuation of application No. 12/548,389, filed on Aug. 26, 2009, now Pat. No. 8,011,748, which is a continuation of application No. 11/544,779, filed on Oct. 10, 2008, now abandoned.

(51) Int. Cl.
*B41J 29/38* (2006.01)

(52) U.S. Cl.
USPC ..... 347/29; 347/11

(58) Field of Classification Search
USPC ..... 347/9–23, 29
See application file for complete search history.

(56) References Cited

U.S. PATENT DOCUMENTS

| | | | | |
|---|---|---|---|---|
| 5,781,205 | A | 7/1998 | Silverbrook | |
| 5,880,762 | A | 3/1999 | Ishinaga et al. | |
| 6,312,096 | B1 | 11/2001 | Koitabashi et al. | |
| 6,974,209 | B2 | 12/2005 | Silverbrook | |
| 7,901,056 | B2 * | 3/2011 | Silverbrook et al. | 347/62 |
| 8,011,748 | B2 * | 9/2011 | North et al. | 347/10 |
| 2001/0050696 | A1 | 12/2001 | Suzuki et al. | |
| 2004/0023567 | A1 | 2/2004 | Koyama et al. | |
| 2005/0280671 | A1 | 12/2005 | Silverbrook et al. | |
| 2006/0007267 | A1 | 1/2006 | Silverbrook et al. | |
| 2006/0087533 | A1 | 4/2006 | Silverbrook | |
| 2006/0092233 | A1 | 5/2006 | Silverbrook | |
| 2006/0125883 | A1 | 6/2006 | Silverbrook | |
| 2006/0221136 | A1 | 10/2006 | Silverbrook et al. | |

* cited by examiner

*Primary Examiner* — Lamson Nguyen
(74) *Attorney, Agent, or Firm* — Cooley LLP

(57) ABSTRACT

A printhead is provided having fluid ejection nozzles, heaters corresponding to each of the nozzles respectively, with each heater heating printing fluid to cause ejection of a drop of the printing fluid through the corresponding nozzle, and circuitry for generating electrical drive pulses having variable power and length for energizing the heaters. The drive pulses are generated to have less energy than the energy required to heat a volume of the printing fluid equivalent to the drop volume, from the temperature at which the printing fluid enters the printhead to the heterogeneous boiling point of the printing fluid.

5 Claims, 2 Drawing Sheets

PRINTHEAD HAVING VARIABLE DRIVE PULSES FOR FLUID EJECTION

CROSS REFERENCE TO RELATED APPLICATION

The present application is a Continuation of U.S. application Ser. No. 12/548,389 filed Aug. 26, 2009, which is a Continuation of U.S. patent application Ser. No. 11/544,779 filed on Oct. 10, 2006 (now abandoned), herein incorporated by reference.

FIELD OF THE INVENTION

The present invention relates to inkjet printers and in particular, inkjet printheads that generate vapor bubbles to eject droplets of ink.

CO-PENDING APPLICATIONS

The following applications have been filed by the Applicant with U.S. patent application Ser. No. 11/544,779:

| | | | | | |
|---|---|---|---|---|---|
| 7,491,911 | 7,946,674 | 7,819,494 | 7,938,500 | 7,845,747 | 7,425,048 |
| 11/544,766 | 7,780,256 | 7,384,128 | 7,604,321 | 7,722,163 | 7,681,970 |
| 7,425,047 | 7,413,288 | | | | |

The disclosures of these co-pending applications are incorporated herein by reference.

CROSS REFERENCES TO RELATED APPLICATIONS

Various methods, systems and apparatus relating to the present invention are disclosed in the following US patents/patent applications filed by the applicant or assignee of the present invention:

| | | | | |
|---|---|---|---|---|
| 6,750,901 | 6,476,863 | 6,788,336 | 7,249,108 | 6,566,858 |
| 6,331,946 | 6,246,970 | 6,442,525 | 7,346,586 | 7,685,423 |
| 6,374,354 | 7,246,098 | 6,816,968 | 6,757,832 | 6,334,190 |
| 6,745,331 | 7,249,109 | 7,197,642 | 7,093,139 | 7,509,292 |
| 7,685,424 | 7,743,262 | 7,210,038 | 7,401,223 | 7,702,926 |
| 7,716,098 | 7,364,256 | 7,258,417 | 7,293,853 | 7,328,968 |
| 7,270,395 | 7,461,916 | 7,510,264 | 7,334,864 | 7,255,419 |
| 7,284,819 | 7,229,148 | 7,258,416 | 7,273,263 | 7,270,393 |
| 6,984,017 | 7,347,526 | 7,357,477 | 7,465,015 | 7,364,255 |
| 7,357,476 | 7,758,148 | 7,284,820 | 7,341,328 | 7,246,875 |
| 7,322,669 | 7,445,311 | 7,452,052 | 7,455,383 | 7,448,724 |
| 7,441,864 | 7,637,588 | 7,648,222 | 7,669,958 | 7,607,755 |
| 7,699,433 | 7,658,463 | 7,506,958 | 7,472,981 | 7,448,722 |
| 7,575,297 | 7,438,381 | 7,441,863 | 7,438,382 | 7,425,051 |
| 7,399,057 | 7,695,097 | 7,686,419 | 7,753,472 | 7,448,720 |
| 7,448,723 | 7,445,310 | 7,399,054 | 7,425,049 | 7,367,648 |
| 7,370,936 | 7,401,886 | 7,506,952 | 7,401,887 | 7,384,119 |
| 7,401,888 | 7,387,358 | 7,413,281 | 7,530,663 | 7,467,846 |
| 7,669,957 | 7,771,028 | 7,758,174 | 7,695,123 | 7,798,600 |
| 7,604,334 | 7,857,435 | 7,708,375 | 7,695,093 | 7,695,098 |
| 7,722,156 | 7,703,882 | 7,510,261 | 7,722,153 | 7,581,812 |
| 7,641,304 | 7,753,470 | 6,623,101 | 6,406,129 | 6,505,916 |
| 6,457,809 | 6,550,895 | 6,457,812 | 7,152,962 | 6,428,133 |
| 7,204,941 | 7,282,164 | 7,465,342 | 7,278,727 | 7,417,141 |
| 7,452,989 | 7,367,665 | 7,138,391 | 7,153,956 | 7,423,145 |
| 7,456,277 | 7,550,585 | 7,122,076 | 7,148,345 | 7,470,315 |
| 7,572,327 | 7,658,792 | 7,709,633 | 7,837,775 | 7,416,280 |
| 7,252,366 | 7,488,051 | 7,360,865 | 7,934,092 | 7,681,000 |
| 7,438,371 | 7,465,017 | 7,441,862 | 7,654,636 | 7,458,659 |
| 7,455,376 | 7,841,713 | 7,877,111 | 7,874,659 | 7,735,993 |
| 11/124,198 | 7,284,921 | 7,407,257 | 7,470,019 | 7,645,022 |

-continued

| | | | | |
|---|---|---|---|---|
| 7,392,950 | 7,843,484 | 7,360,880 | 7,517,046 | 7,236,271 |
| 11/124,174 | 7,753,517 | 7,824,031 | 7,465,047 | 7,607,774 |
| 7,780,288 | 11/124,172 | 7,566,182 | 11/124,182 | 7,715,036 |
| 11/124,181 | 7,697,159 | 7,595,904 | 7,726,764 | 7,770,995 |
| 7,370,932 | 7,404,616 | 11/124,187 | 7,740,347 | 7,500,268 |
| 7,558,962 | 7,447,908 | 7,792,298 | 7,661,813 | 7,456,994 |
| 7,431,449 | 7,466,444 | 11/124,179 | 7,680,512 | 7,878,645 |
| 7,562,973 | 7,530,446 | 7,761,090 | 11/228,500 | 7,668,540 |
| 7,738,862 | 7,805,162 | 7,924,450 | 7,953,386 | 7,738,919 |
| 11/228,507 | 7,708,203 | 7,641,115 | 7,697,714 | 7,654,444 |
| 7,831,244 | 7,499,765 | 7,894,703 | 7,756,526 | 7,844,257 |
| 7,558,563 | 7,953,387 | 7,856,225 | 7,945,943 | 7,747,280 |
| 7,742,755 | 7,738,674 | 7,864,360 | 7,506,802 | 7,724,399 |
| 11/228,527 | 7,403,797 | 11/228,520 | 7,646,503 | 7,843,595 |
| 7,672,664 | 7,920,896 | 7,783,323 | 7,843,596 | 7,778,666 |
| 7,970,435 | 7,917,171 | 7,558,599 | 7,855,805 | 7,920,854 |
| 7,880,911 | 7,438,215 | 7,689,249 | 7,621,442 | 7,575,172 |
| 7,357,311 | 7,380,709 | 7,428,986 | 7,403,796 | 7,407,092 |
| 7,848,777 | 7,637,424 | 7,469,829 | 7,774,025 | 7,558,597 |
| 7,558,598 | 6,238,115 | 6,386,535 | 6,398,344 | 6,612,240 |
| 6,752,549 | 6,805,049 | 6,971,313 | 6,899,480 | 6,860,664 |
| 6,925,935 | 6,966,636 | 7,024,995 | 7,284,852 | 6,926,455 |
| 7,056,038 | 6,869,172 | 7,021,843 | 6,988,845 | 6,964,533 |
| 6,981,809 | 7,284,822 | 7,258,067 | 7,322,757 | 7,222,941 |
| 7,284,925 | 7,278,795 | 7,249,904 | 7,152,972 | 7,744,195 |
| 7,645,026 | 7,322,681 | 7,708,387 | 7,753,496 | 7,712,884 |
| 7,510,267 | 7,465,041 | 7,857,428 | 7,465,032 | 7,401,890 |
| 7,401,910 | 7,470,010 | 7,735,971 | 7,431,432 | 7,465,037 |
| 7,445,317 | 7,549,735 | 7,597,425 | 7,661,800 | 7,712,869 |
| 7,156,508 | 7,159,972 | 7,083,271 | 7,165,834 | 7,080,894 |
| 7,201,469 | 7,090,336 | 7,156,489 | 7,413,283 | 7,438,385 |
| 7,083,257 | 7,258,422 | 7,255,423 | 7,219,980 | 7,591,533 |
| 7,416,274 | 7,367,649 | 7,118,192 | 7,618,121 | 7,322,672 |
| 7,077,505 | 7,198,354 | 7,077,504 | 7,614,724 | 7,198,355 |
| 7,401,894 | 7,322,676 | 7,152,959 | 7,213,906 | 7,178,901 |
| 7,222,938 | 7,108,353 | 7,104,629 | 7,455,392 | 7,370,939 |
| 7,429,095 | 7,404,621 | 7,261,401 | 7,461,919 | 7,438,388 |
| 7,328,972 | 7,322,673 | 7,303,930 | 7,401,405 | 7,464,466 |
| 7,464,465 | 7,246,886 | 7,128,400 | 7,108,355 | 6,991,322 |
| 7,287,836 | 7,118,197 | 7,575,298 | 7,364,269 | 7,077,493 |
| 6,962,402 | 7,686,429 | 7,147,308 | 7,524,034 | 7,118,198 |
| 7,168,790 | 7,172,270 | 7,229,155 | 6,830,318 | 7,195,342 |
| 7,175,261 | 7,465,035 | 7,108,356 | 7,118,202 | 7,510,269 |
| 7,134,744 | 7,510,270 | 7,134,743 | 7,182,439 | 7,210,768 |
| 7,465,036 | 7,134,745 | 7,156,484 | 7,118,201 | 7,111,926 |
| 7,431,433 | 7,018,021 | 7,401,901 | 7,468,139 | 7,128,402 |
| 7,387,369 | 7,484,832 | 7,802,871 | 7,506,968 | 7,284,839 |
| 7,246,885 | 7,229,156 | 7,533,970 | 7,467,855 | 7,293,858 |
| 7,258,427 | 7,448,729 | 7,246,876 | 7,431,431 | 7,419,249 |
| 7,377,623 | 7,328,978 | 7,334,876 | 7,147,306 | 7,654,645 |
| 7,784,915 | 7,721,948 | 7,079,712 | 6,825,945 | 7,330,974 |
| 6,813,039 | 6,987,506 | 7,038,797 | 6,980,318 | 6,816,274 |
| 7,102,772 | 7,350,236 | 6,681,045 | 6,728,000 | 7,173,722 |
| 7,088,459 | 7,707,082 | 7,068,382 | 7,062,651 | 6,789,194 |
| 6,789,191 | 6,644,642 | 6,502,614 | 6,622,999 | 6,669,385 |
| 6,549,935 | 6,987,573 | 6,727,996 | 6,591,884 | 6,439,706 |
| 6,760,119 | 7,295,332 | 6,290,349 | 6,428,155 | 6,785,016 |
| 6,870,966 | 6,822,639 | 6,737,591 | 7,055,739 | 7,233,320 |
| 6,830,196 | 6,832,717 | 6,957,768 | 7,456,820 | 7,170,499 |
| 7,106,888 | 7,123,239 | 7,377,608 | 7,399,043 | 7,121,639 |
| 7,165,824 | 7,152,942 | 7,818,519 | 7,181,572 | 7,096,137 |
| 7,302,592 | 7,278,034 | 7,188,282 | 7,592,829 | 7,770,008 |
| 7,707,621 | 7,523,111 | 7,573,301 | 7,660,998 | 7,783,886 |
| 7,831,827 | 7,171,323 | 7,278,697 | 7,360,131 | 7,519,772 |
| 7,328,115 | 7,369,270 | 6,795,215 | 7,070,098 | 7,154,638 |
| 6,805,419 | 6,859,289 | 6,977,751 | 6,398,332 | 6,394,573 |
| 6,622,923 | 6,747,760 | 6,921,144 | 7,092,112 | 7,192,106 |
| 7,457,001 | 7,173,739 | 6,986,560 | 7,008,033 | 7,551,324 |
| 7,222,780 | 7,270,391 | 7,525,677 | 7,388,689 | 7,571,906 |
| 7,195,328 | 7,182,422 | 7,374,266 | 7,427,117 | 7,448,707 |
| 7,281,330 | 7,328,956 | 7,735,944 | 7,188,928 | 7,093,989 |
| 7,377,609 | 7,600,843 | 10/854,498 | 7,390,071 | 7,549,715 |
| 7,252,353 | 7,607,757 | 7,267,417 | 7,517,036 | 7,275,805 |
| 7,314,261 | 7,281,777 | 7,290,852 | 7,484,831 | 7,758,143 |
| 7,832,842 | 7,549,718 | 7,866,778 | 7,631,190 | 7,557,941 |
| 7,757,086 | 7,266,661 | 7,243,193 | 7,163,345 | 7,322,666 |
| 7,465,033 | 7,452,055 | 7,470,002 | 7,722,161 | 7,475,963 |
| 7,448,735 | 7,465,042 | 7,448,739 | 7,438,399 | 7,467,853 |
| 7,461,922 | 7,465,020 | 7,722,185 | 7,461,910 | 7,270,494 |
| 7,632,032 | 7,475,961 | 7,547,088 | 7,611,239 | 7,735,955 |

-continued

| | | | | |
|---|---|---|---|---|
| 7,758,038 | 7,681,876 | 7,780,161 | 7,703,903 | 7,448,734 |
| 7,425,050 | 7,364,263 | 7,201,468 | 7,360,868 | 7,234,802 |
| 7,303,255 | 7,287,846 | 7,156,511 | 7,258,432 | 7,097,291 |
| 7,645,025 | 7,083,273 | 7,367,647 | 7,374,355 | 7,441,880 |
| 7,547,092 | 7,513,598 | 7,198,352 | 7,364,264 | 7,303,251 |
| 7,201,470 | 7,121,655 | 7,293,861 | 7,232,208 | 7,328,985 |
| 7,344,232 | 7,083,272 | 7,311,387 | 7,621,620 | 7,669,961 |
| 7,331,663 | 7,360,861 | 7,328,973 | 7,427,121 | 7,407,262 |
| 7,303,252 | 7,249,822 | 7,537,309 | 7,311,382 | 7,360,860 |
| 7,364,257 | 7,390,075 | 7,350,896 | 7,429,096 | 7,384,135 |
| 7,331,660 | 7,416,287 | 7,488,052 | 7,322,684 | 7,322,685 |
| 7,311,381 | 7,270,405 | 7,303,268 | 7,470,007 | 7,399,072 |
| 7,393,076 | 7,681,967 | 7,588,301 | 7,249,833 | 7,524,016 |
| 7,490,927 | 7,331,661 | 7,524,043 | 7,300,140 | 7,357,492 |
| 7,357,493 | 7,566,106 | 7,380,902 | 7,284,816 | 7,284,845 |
| 7,255,430 | 7,390,080 | 7,328,984 | 7,350,913 | 7,322,671 |
| 7,380,910 | 7,431,424 | 7,470,006 | 7,585,054 | 7,347,534 |
| 7,441,865 | 7,469,989 | 7,367,650 | 7,469,990 | 7,441,882 |
| 7,556,364 | 7,357,496 | 7,467,863 | 7,431,440 | 7,431,443 |
| 7,527,353 | 7,524,023 | 7,513,603 | 7,467,852 | 7,465,045 |
| 7,645,034 | 7,637,602 | 7,645,033 | 7,661,803 | 7,841,708 |

An application has been listed by its docket number. This will be replaced when application number is known. The disclosures of these applications and patents are incorporated herein by reference.

BACKGROUND TO THE INVENTION

The present invention involves the ejection of ink drops by way of forming gas or vapor bubbles in a bubble forming liquid. This principle is generally described in U.S. Pat. No. 3,747,120 to Stemme. These devices have heater elements in thermal contact with ink that is disposed adjacent the nozzles, for heating the ink thereby forming gas bubbles in the ink. The gas bubbles generate pressures in the ink causing ink drops to be ejected through the nozzles.

The resistive heaters operate in an extremely harsh environment. They must heat and cool in rapid succession to form bubbles in the ejectable liquid, usually a water soluble ink. These conditions are highly conducive to the oxidation and corrosion of the heater material. Dissolved oxygen in the ink can attack the heater surface and oxidise the heater material. In extreme circumstances, the heaters 'burn out' whereby complete oxidation of parts of the heater breaks the heating circuit.

The heater can also be eroded by 'cavitation' caused by the severe hydraulic forces associated with the surface tension of a collapsing bubble.

To protect against the effects of oxidation, corrosion and cavitation on the heater material, inkjet manufacturers use stacked protective layers, typically made from $Si_3N_4$, SiC and Ta. Because of the severe operating conditions, the protective layers need to be relatively thick. U.S. Pat. No. 6,786,575 to Anderson et al (assigned to Lexmark) is an example of this structure, and the heater material is ~0.1 μm thick while the total thickness of the protective layers is at least 0.7 μm.

To form a vapor bubble in the bubble forming liquid, the heater (i.e. the heater material and the protective coatings) must be heated to the superheat limit of the liquid (~300° C. for water). This requires a large amount of energy to be supplied to the heater. However, only a portion of this energy is used to vaporize ink. Most of the 'excess' energy must be dissipated by the printhead and or a cooling system. The heat from the excess energy of successive droplet ejections can not raise the steady state temperature of the ink above its boiling point and thereby cause unintentional bubbles. This limits the density of the nozzles on the printhead, the nozzle firing rate and usually necessitates an active cooling system. This in turn has an impact on the print resolution, the printhead size, the print speed and the manufacturing costs.

Attempts to increase nozzle density and firing rate are hindered by limitations on thermal conduction out of the printhead integrated circuit (chip), which is currently the primary cooling mechanism of printheads on the market. Existing printheads on the market require a large heat sink to dissipate heat absorbed from the printhead IC.

Inkjet printheads can also suffer from a problem commonly referred to as 'decap'. This term is defined below. During periods of inactivity, evaporation of the volatile component of the bubble forming liquid will occur at the liquid-air interface in the nozzle. This will decrease the concentration of the volatile component in the liquid near the heater and increase the viscosity of the liquid in the chamber. The decrease in concentration of the volatile component will result in the production of less vapor in the bubble, so the bubble impulse (pressure integrated over area and time) will be reduced: this will decrease the momentum of ink forced through the nozzle and the likelihood of drop break-off. The increase in viscosity will also decrease the momentum of ink forced through the nozzle and increase the critical wavelength for the Rayleigh Taylor instability governing drop break-off, decreasing the likelihood of drop break-off. If the nozzle is left idle for too long, these phenomena will result in a "decapped nozzle" i.e. a nozzle that is unable to eject the liquid in the chamber. The "decap time" refers to the maximum time a nozzle can remain unfired before evaporation will decap the nozzle.

SUMMARY OF THE INVENTION

Accordingly, the present invention provides an inkjet printhead for printing a media substrate, the printhead comprising:

a plurality of nozzles;

a plurality of heaters corresponding to each of the nozzles respectively, each heater being configured for heating printing fluid to nucleate a vapor bubble that ejects a drop of the printing fluid through the corresponding nozzle; and, drive circuitry for generating an electrical drive pulse to energize the heaters; wherein, the drive circuitry is configured to adjust the drive pulse power to vary the vapor bubble nucleation time.

The power supplied to each heater determines the time scale for heating it to the 309° C. ink superheat limit, where film boiling on the surface of the heater spontaneously nucleates a bubble. The time scale for reaching the superheat limit determines two things: the energy required to nucleate the bubble and the impulse delivered by the bubble (impulse being pressure integrated over area and time). By varying the power of the pulse used to generate the bubble, the printhead can operate with small, efficiently generated bubbles during normal printing, or it can briefly operate with large high energy bubbles if it needs to recover decapped nozzles.

In preferred embodiments, the power supplied to the heaters in printing mode is sufficient to cause nucleation in less than 1 μs, and more preferably between 0.4 μs and 0.5 μs, and the power supplied to the heaters in maintenance mode results in nucleation times above 1 μs.

In some forms, the energy in each printing pulse is less than the maximum amount of thermal energy that can be removed by the drop, being the energy required to heat a volume of the ejectable liquid equivalent to the drop volume from the temperature at which the liquid enters the printhead to the heterogeneous boiling point of the ejectable liquid. In this form, the printhead is "self cooling", a mode of operation in which the nozzle density and nozzle fire rate are unconstrained by conductive heatsinking, an advantage that facilitates integrating the printhead into a pagewidth printer.

In some forms, the power delivered to each heater may be adjusted by changing the voltage level of the pulse supplied to the heater. In other forms, the power is adjusted using pulse width modulation of the voltage pulse, to adjust the time averaged power of the pulse.

Optionally, the drive circuitry is configured to operate in a normal printing mode and a high impulse mode such that the drive pulses are less than 1 microsecond long in the normal printing mode and greater than 1 microsecond long in the high impulse mode.

Optionally, the high impulse mode is a maintenance mode used to recover nozzles affected by decap.

Optionally, the high impulse mode is used to increase the volume of the ejected drops of printing fluid.

Optionally, the high impulse mode is used to compensate for printing fluid with higher viscosity than other printing fluid ejected during the normal printing mode, to provide more consistent drop volumes.

Optionally, each of the drive pulses has less energy than the energy required to heat a volume of the printing fluid equivalent to the drop volume, from the temperature at which the printing fluid enters the printhead to the heterogeneous boiling point of the printing fluid.

Optionally, the drive pulse power is adjusted in response to temperature feedback from the array of nozzles.

Optionally, the drive pulse power is adjusted by changing its voltage.

Optionally, the drive pulse power is adjusted using pulse width modulation to change the time averaged power of the drive pulse.

Optionally, the maintenance mode operates before the printhead prints to a sheet of media substrate.

Optionally, the maintenance mode operates after the printhead prints a sheet of media substrate and before it prints a subsequent sheet of media substrate.

Accordingly in a second aspect the present invention provides a MEMS vapour bubble generator comprising:

a chamber for holding liquid;

a heater positioned in the chamber for thermal contact with the liquid; and, drive circuitry for providing the heater with an electrical pulse such that the heater generates a vapour bubble in the liquid; wherein, the pulse has a first portion with insufficient power to nucleate the vapour bubble and a second portion with power sufficient to nucleate the vapour bubble, subsequent to the first portion.

If the heating pulse is shaped to increase the heating rate prior to the end of the pulse, bubble stability can be greatly enhanced, allowing access to a regime where large, repeatable bubbles can be produced by small heaters.

Preferably the first portion of the pulse is a pre-heat section for heating the liquid but not nucleating the vapour bubble and the second portion is a trigger section for nucleating the vapour bubble. In a further preferred form, the pre-heat section has a longer duration than the trigger section. Preferably, the pre-heat section is at least two micro-seconds long. In a further preferred form, the trigger section is less than a micro-section long.

Preferably, the drive circuitry shapes the pulse using pulse width modulation. In this embodiment, the pre-heat section is a series of sub-nucleating pulses. Optionally, the drive circuitry shapes the pulse using voltage modulation.

In some embodiments, the time averaged power in the pre-heat section is constant and the time averaged power in the trigger section is constant. In particularly preferred embodiments, the MEMS vapour bubble generator is used in an inkjet printhead to eject printing fluid from nozzle in fluid communication with the chamber.

Using a low power over a long time scale (typically >>1 μs) to store a large amount of thermal energy in the liquid surrounding the heater without crossing over the nucleation temperature, then switching to a high power to cross over the nucleation temperature in a short time scale (typically <1 μs), triggers nucleation and releasing the stored energy.

Optionally, the first portion of the pulse is a pre-heat section for heating the liquid but not nucleating the vapour bubble and the second portion is a trigger section for superheating some of the liquid to nucleate the vapour bubble.

Optionally, the pre-heat section has a longer duration than the trigger section.

Optionally, the pre-heat section is at least two micro-seconds long.

Optionally, the trigger section is less than one micro-section long.

Optionally, the drive circuitry shapes the pulse using pulse width modulation.

Optionally, the pre-heat section is a series of sub-nucleating pulses.

Optionally, the drive circuitry shapes the pulse using voltage modulation.

Optionally, the time averaged power in the pre-heat section is constant and the time averaged power in the trigger section is constant.

In another aspect the present invention provides a MEMS vapour bubble generator used in an inkjet printhead to eject printing fluid from a nozzle in fluid communication with the chamber.

Optionally, the heater is suspended in the chamber for immersion in a printing fluid.

Optionally, the pulse is generated for recovering a nozzle clogged with dried or overly viscous printing fluid.

TERMINOLOGY

"Power" in the context of this specification is defined as the energy required to nucleate a bubble, divided by the nucleation time of the bubble.

Throughout the specification, references to 'self cooled' or 'self cooling' nozzles will be understood to be nozzles in which the energy required to eject a drop of the ejectable liquid is less than the maximum amount of thermal energy that can be removed by the drop, being the energy required to heat a volume of the ejectable fluid equivalent to the drop volume from the temperature at which the fluid enters the printhead to the heterogeneous boiling point of the ejectable fluid.

The term "decap" is a reference to the phenomenon whereby evaporation from idle nozzles reduces the concentration of water in the vicinity of the heater (reducing bubble impulse) and increases the viscosity of the ink (increasing flow resistance). The term "decap time" is well known and often used in this field. Throughout this specification, "the decap time" is the maximum interval that a nozzle can remain unfired before evaporation of the volatile component of the bubble forming liquid will render the nozzle incapable of ejecting the bubble forming liquid.

The printhead according to the invention comprises a plurality of nozzles, as well as a chamber and one or more heater elements corresponding to each nozzle. Each portion of the printhead pertaining to a single nozzle, its chamber and its one or more elements, is referred to herein as a "unit cell".

In this specification, where reference is made to parts being in thermal contact with each other, this means that they are positioned relative to each other such that, when one of the parts is heated, it is capable of heating the other part, even though the parts, themselves, might not be in physical contact with each other.

Also, the term "printing fluid" is used to signify any ejectable liquid, and is not limited to conventional inks containing colored dyes. Examples of non-colored inks include fixatives, infra-red absorbent inks, functionalized chemicals, adhesives, biological fluids, water and other solvents, and so on. The ink or ejectable liquid also need not necessarily be a strictly a liquid, and may contain a suspension of solid particles or be solid at room temperature and liquid at the ejection temperature.

BRIEF DESCRIPTION OF THE DRAWINGS

Preferred embodiments of the invention will now be described by way of example only with reference to the accompanying drawings in which.

DETAILED DESCRIPTION OF THE PREFERRED EMBODIMENTS

Figure 1:
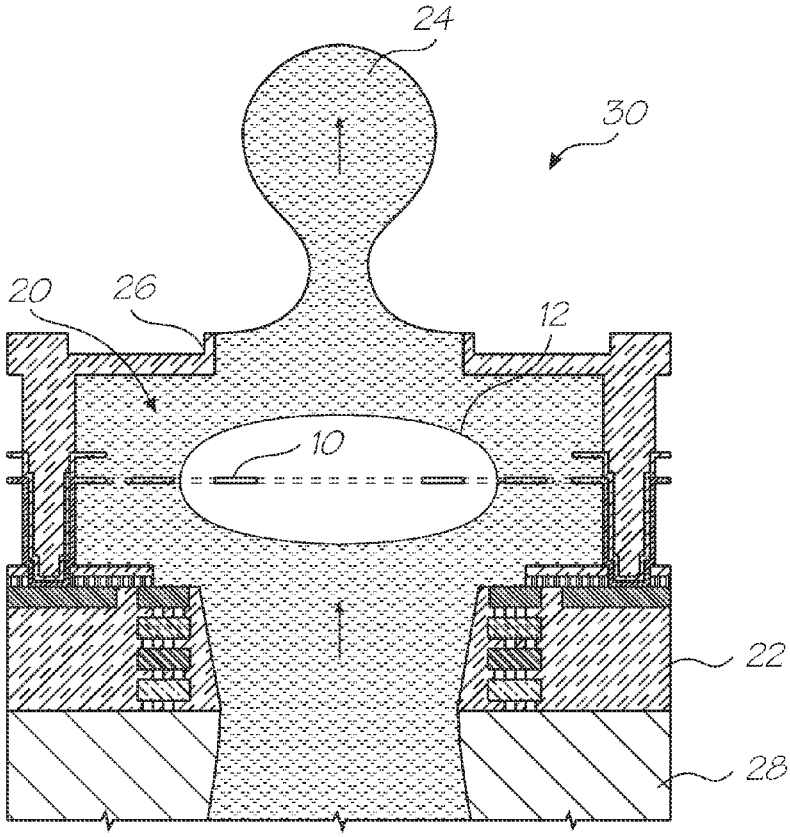
FIG. 1 is a sketch of a single unit cell from a thermal inkjet printhead.

FIG. 1 shows the MEMS bubble generator of the present invention applied to an inkjet printhead. A detailed description of the fabrication and operation of some of the Applicant's thermal printhead IC's is provided in U.S. Ser. No. 11/097,308 and U.S. Ser. No. 11/246,687. In the interests of brevity, the contents of these documents are incorporated herein by reference.

A single unit cell 30 is shown in FIG. 1. It will be appreciated that many unit cells are fabricated in a close-packed array on a supporting wafer substrate 28 using lithographic etching and deposition techniques common within in the field semi-conductor/MEMS fabrication. The chamber 20 holds a quantity of ink. The heater 10 is suspended in the chamber 20 such that it is in electrical contact with the CMOS drive circuitry 22. Drive pulses generated by the drive circuitry 22 energize the heater 10 to generate a vapour bubble 12 that forces a droplet of ink 24 through the nozzle 26.

The heat that diffuses into the ink and the underlying wafer prior to nucleation has an effect on the volume of fluid that vaporizes once nucleation has occurred and consequently the impulse of the vapor explosion (impulse=force integrated over time). Heaters driven with shorter, higher voltage heater pulses have shorter ink decap times. This is explained by the reduced impulse of the vapor explosion, which is less able to push ink made viscous by evaporation through the nozzle.

Using the drive circuitry 22 to shape the pulse in accordance with the present invention gives the designer a broader range of bubble impulses from a single heater and drive voltage.

Figure 2:
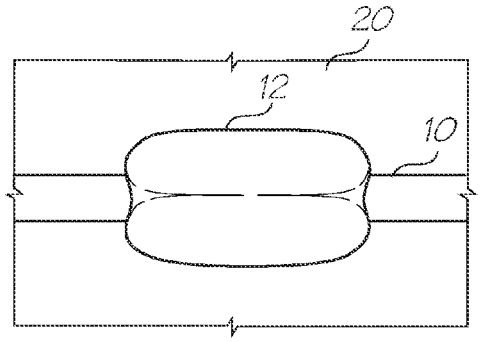
FIG. 2 shows the bubble formed by a heater energised by a 'printing mode' pulse.

FIG. 2 is a line drawing of a stroboscopic photograph of a bubble 12 formed on a heater 10 during open pool testing (the heater is immersed in water and pulsed). The heater 10 is 30 microns by 4 microns by 0.5 microns and formed from TiAl mounted on a silicon wafer substrate. The pulse was 3.45 V for 0.4 microseconds making the energy consumed 127 nJ. The strobe captures the bubble at it's maximum extent, prior to condensing and collapsing to a collapse point. It should be noted that the dual lobed appearance is due to reflection of the bubble image from the wafer surface.

The time taken for the bubble to nucleate is the key parameter. Higher power (voltages) imply higher heating rates, so the heater reaches the bubble nucleation temperature more quickly, giving less time for heat to conduct into the heater's surrounds, resulting in a reduction in thermal energy stored in the ink at nucleation. This in turn reduces the amount of water vapor produced and therefore the bubble impulse. However, less energy is required to form the bubble because less heat is lost from the heater prior to nucleation. This is, therefore, how the printer should operate during normal printing in order to be as efficient as possible.

Figure 3:
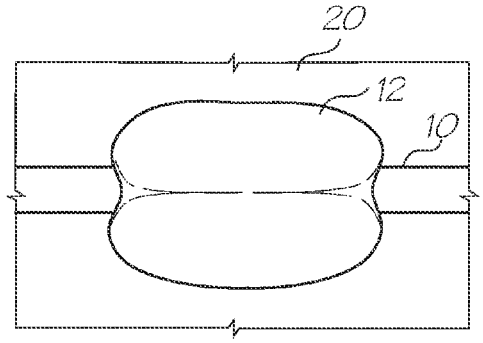
FIG. 3 shows the bubble formed by a heater energised by a 'maintenance mode' pulse.

FIG. 3 shows the bubble 12 from the same heater 10 when the pulse is 2.20 V for 1.5 microseconds. This has an energy requirement of 190 nJ but the bubble generated is much larger. The bubble has a greater bubble impulse and so can be used for a maintenance pulse or to eject bigger than normal drops. This permits the printhead to have multiple modes of operation which are discussed in more detail below.

Figure 4:
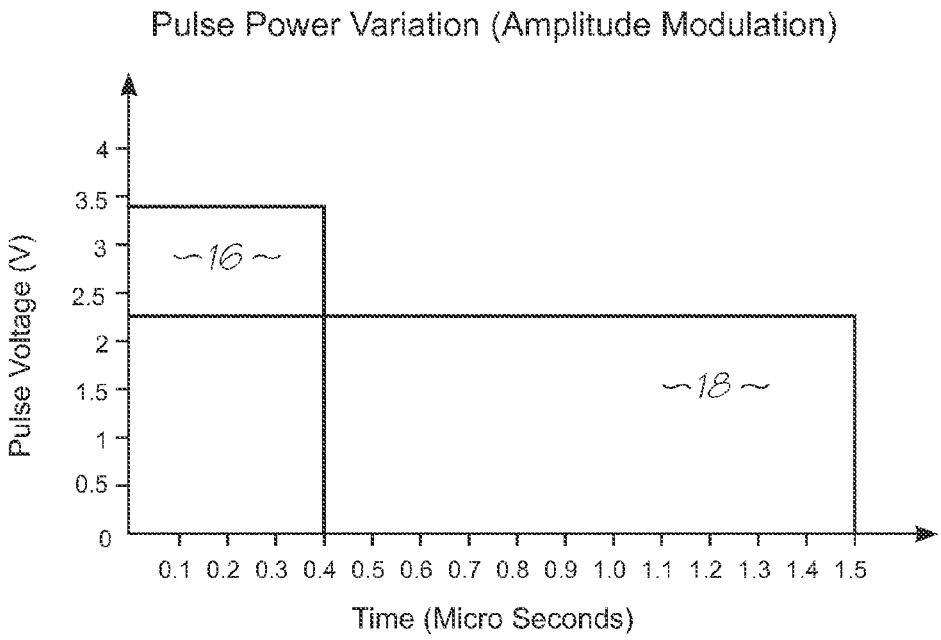
FIG. 4 is a voltage versus time plot of the variation of the pulse power using amplitude modulation; and, FIG. 5 is a voltage versus time plot of the variation of the pulse power using pulse width modulation.

FIG. 4 shows the variation of the drive pulse using amplitude modulation. The normal printing mode pulse 16 has a higher power and therefore shorter duration as nucleation is reached quickly. The large bubble mode pulse 18 has lower power and a longer duration to match the increased nucleation time.

Figure 5:
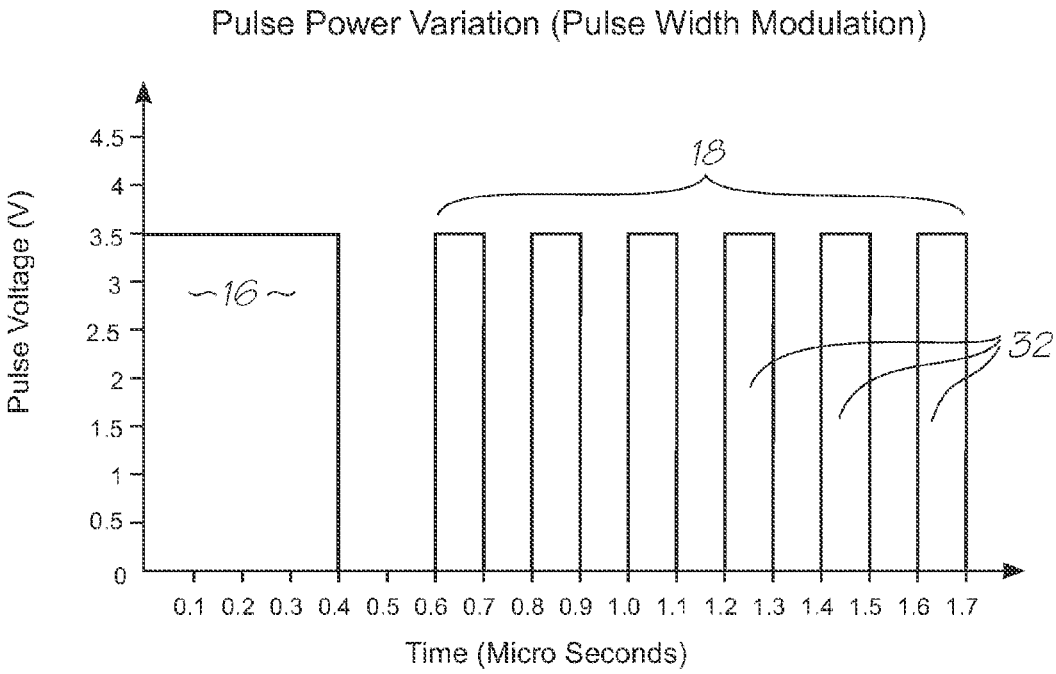

FIG. 5 shows the variation of the drive pulse using pulse width modulation. The normal printing pulse 16 is again 3.45 V for 0.4 microseconds. However, the large bubble pulse 18 is a series of short pulses 32, all at the same voltage (3.45 V) but only 0.1 microseconds long with 0.1 microsecond breaks between. The power during one of the short pulses 32 is the same as that of the normal printing pulse 16, but the time averaged power of the entire large bubble pulse is lower.

Lower power will increase the time scale for reaching the superheat limit. The energy required to nucleate a bubble will be higher, because there is more time for heat to leak out of the heater prior to nucleation (additional energy that must be supplied by the heater). Some of this additional energy is stored in the ink and causes more vapor to be produced by nucleation. The increased vapor provides a bigger bubble and therefore greater bubble impulse. Lower power thus results in increased bubble impulse, at the cost of increased energy.

This permits the printhead to operate in multiple modes, for example:

a normal printing mode with high power delivered to each heater (low bubble impulse, low energy requirement);

a maintenance mode with low power delivered to each heater to recover decapped nozzles (high bubble impulse, high energy requirement);

a start up mode with lower power drive pulses when the ink is at a low temperature and therefore more viscous;

a draft mode that prints only half the dots (for greater print speeds) with lower power drive pulses for bigger bubbles to increase the volume of the ejected drops thereby improving the look of the draft image; or, a dead nozzle compensation mode where larger drops are ejected from some nozzles to compensate for dead nozzles within the array.

A primary objective for the printhead designer is low energy ejection, particularly if the nozzle density and nozzle fire rate (print speed) are high. The Applicant's MTC001US referenced above provides a detailed discussion of the benefits of low energy ejection as well as a comprehensive analysis of energy consumption during the ejection process. The energy of ejection affects the steady state temperature of the printhead, which must be kept within a reasonable range to control the ink viscosity and prevent the ink from boiling in the steady state. However, there is a drawback in designing the printhead for low energy printing: the low bubble impulse resulting from low energy operation makes the nozzles particularly sensitive to decap. Depending on the nozzle idle time and extent of decap, it may not be possible to eject from decapped nozzles with a normal printing pulse, because the bubble impulse may be too low. It is desirable, therefore, to switch to a maintenance mode with higher bubble impulse if and when nozzles must be cleared to recover from or prevent decap e.g. at the start of a print job or between pages. In this mode the printhead temperature is not as sensitive to the energy required for each pulse, as the total number of pulses required for maintenance is lower than for printing and the time scale over which the pulses can be delivered is longer.

Similarly, temperature feedback from the printhead can be used as an indication of the ink temperature and therefore, the ink viscosity. Modulating the drive pulses can be used to ensure consistent drop volumes. The printhead IC disclosed in the co-pending PUA001US to PUA015US (cross referenced above) describe how 'on chip' temperature sensors can be incorporated into the nozzle array and drive circuitry.

The invention has been described herein by way of example only. Ordinary workers in this field will readily recognize many variations and modifications which do not depart from the spirit and scope of the broad inventive concept.

The invention claimed is:

1. A printhead comprising:

a plurality of fluid ejection nozzles;

a plurality of heaters corresponding to each of the nozzles respectively, each heater being configured for heating printing fluid to cause ejection of a drop of the printing fluid through the corresponding nozzle; and circuitry for generating electrical drive pulses having variable power and length for energizing the heaters, wherein the circuitry is configured to generate:

relatively shorter drive pulses for generating bubbles used in a normal printing mode; and relatively longer drive pulses for generating high impulse bubbles used in a maintenance mode to recover nozzles affected by decap.

2. A printhead according to claim 1 wherein the drive pulse power is varied by the circuitry based on a temperature of the nozzles.

3. A printhead according to claim 1 wherein the drive pulse power is varied by changing a drive pulse voltage.

4. A printhead according to claim 1 wherein the drive pulse power is varied using pulse width modulation to change a time averaged power of the drive pulses.

5. A printhead according to claim 4 wherein the relatively longer drive pulses use in the maintenance mode have a length of greater than one microsecond and the relatively shorter driver pulses used in normal printing mode have a length of less than one microsecond.

* * * * *